United States Patent [19]

Doner et al.

[11] Patent Number: 4,780,227

[45] Date of Patent: Oct. 25, 1988

[54] GREASE COMPOSITION CONTAINING BORATED ALKOXYLATED ALCOHOLS

[75] Inventors: John P. Doner, Sewell; Andrew G. Horodysky, Cherry Hill; John A. Keller, Jr., Pitman, all of N.J.

[73] Assignee: Mobil Oil Corporation, New York, N.Y.

[21] Appl. No.: 51,158

[22] Filed: May 4, 1987

Related U.S. Application Data

[63] Continuation of Ser. No. 831,073, Feb. 18, 1986, abandoned, which is a continuation of Ser. No. 643,344, Aug. 22, 1984, abandoned.

[51] Int. Cl.[4] ..... C10M 117/02; C10M 139/00; C10M 137/14

[52] U.S. Cl. ..... 252/32.7 E; 252/49.6; 252/52 A

[58] Field of Search ..... 252/32.7 E, 42, 49.6

[56] References Cited

U.S. PATENT DOCUMENTS

| | | | |
|---|---|---|---|
| 2,053,474 | 9/1936 | Graves et al. | 260/98 |
| 2,397,956 | 4/1946 | Fraser | 252/40 |
| 2,703,784 | 3/1955 | Fields | 252/32.7 |
| 2,703,785 | 3/1955 | Roberts et al. | 252/33.4 |
| 2,813,830 | 11/1957 | Trautman | 252/49.6 |
| 2,815,325 | 12/1957 | Pohorilla et al. | 252/42.1 |
| 2,905,644 | 9/1959 | Butter | 252/392 |
| 2,943,054 | 6/1960 | Worth | 252/40.7 |
| 2,975,134 | 3/1961 | Cook | 252/40.7 |
| 3,009,791 | 11/1961 | Emrick | 44/63 |
| 3,012,968 | 12/1961 | Emrick et al. | 252/49.6 |
| 3,095,375 | 6/1963 | Pitman | 252/28 |
| 3,125,523 | 3/1964 | Siegart et al. | 252/33.6 |
| 3,125,524 | 3/1964 | Siegart et al. | 252/33.6 |
| 3,125,525 | 3/1964 | Siegart et al. | 252/33.6 |
| 3,158,574 | 11/1964 | Greenwood et al. | 252/36 |
| 3,224,971 | 12/1965 | Knowles et al. | 252/46.3 |
| 3,361,672 | 1/1968 | Andress et al. | 252/49.6 |
| 3,446,808 | 5/1969 | Cyba | 260/250 |
| 3,625,899 | 12/1971 | Sawyer | 252/75 |
| 3,697,574 | 10/1972 | Piasek | 260/462 R |
| 3,704,308 | 11/1972 | Piasek et al. | 260/462 R |
| 3,711,411 | 1/1973 | Sawyer et al. | 252/49.6 |
| 3,711,412 | 1/1973 | Sawyer et al. | 252/78 |
| 3,736,357 | 5/1973 | Piasek et al. | 260/570.5 P |
| 3,751,365 | 8/1973 | Piasek et al. | 252/49.6 |
| 3,758,407 | 9/1973 | Harting | 252/18 |
| 3,923,712 | 12/1975 | Vickery | 260/28.5 B |
| 4,016,092 | 4/1977 | Andress | 252/32.5 |
| 4,071,548 | 1/1978 | Okamoto | 260/462 R |
| 4,097,389 | 6/1978 | Andress | 252/51.5 A |
| 4,140,492 | 2/1979 | Feldman et al. | 44/62 |
| 4,159,957 | 7/1979 | deVries | 252/33.4 |
| 4,182,823 | 1/1980 | Schoenberg | 526/298 |
| 4,244,829 | 1/1981 | Coupland et al. | 252/56 R |
| 4,317,739 | 3/1982 | Spence | 252/47.5 |
| 4,328,113 | 5/1982 | Horodysky et al. | 252/49.6 |
| 4,370,248 | 1/1983 | Horodysky et al. | 252/49.6 |
| 4,374,032 | 2/1983 | Gemmill et al. | 252/49.6 |
| 4,376,712 | 3/1983 | Horodysky et al. | 252/49.6 |
| 4,382,006 | 5/1983 | Horodysky | 252/49.6 |
| 4,389,322 | 6/1983 | Horodysky | 252/49.6 |
| 4,394,278 | 7/1983 | Horodysky et al. | 252/46.3 |
| 4,402,842 | 9/1983 | Horodysky et al. | 252/47.5 |
| 4,406,802 | 9/1983 | Horodysky et al. | 252/49.6 |
| 4,410,438 | 10/1983 | Horodysky et al. | 252/49.6 |
| 4,426,305 | 1/1984 | Malec | 252/49.6 |
| 4,440,656 | 4/1984 | Horodysky | 252/49.6 |
| 4,472,289 | 9/1984 | Horodysky et al. | 252/49.6 |
| 4,486,321 | 12/1984 | Horodysky et al. | 252/46.3 |
| 4,524,005 | 6/1985 | Horodysky | 252/49.6 |
| 4,529,529 | 7/1985 | Horodysky | 252/49.6 |
| 4,582,617 | 4/1986 | Doner et al. | 252/32.7 E |

FOREIGN PATENT DOCUMENTS

| | | |
|---|---|---|
| 711234 | 6/1965 | Canada . |
| 0067002 | 12/1982 | European Pat. Off. . |
| 0075478 | 3/1983 | European Pat. Off. . |
| 0134063 | 3/1985 | European Pat. Off. . |
| 1400020 | 7/1975 | United Kingdom . |
| 2102023 | 1/1983 | United Kingdom . |
| 2103651 | 2/1983 | United Kingdom . |
| 2106133 | 4/1983 | United Kingdom . |
| 2107734 | 5/1983 | United Kingdom . |
| 2125431 | 3/1984 | United Kingdom . |

OTHER PUBLICATIONS

Smalheer et al., "Lubricant Compositions," 1967, Chap. 1.

Boner, "Lubricating Greases", 1954, pp. 436–437.

C. J. Boner, "Manufacture and Application of Lubricating Greases", 1954, pp. 435–437, 497–498, 157.

C. V. Smalheer & R. K. Smith, "Lubricant Additives", 1967, Section 1, pp. 1–11, Chapter 1.

G. G. Hawley, "The Condensed Chemical Dictionary", Ninth Edition, pp. 520 and 938.

*Primary Examiner*—William R. Dixon, Jr.
*Assistant Examiner*—Margaret B. Medley
*Attorney, Agent, or Firm*—A. J. McKillop; M. G. Gilman; Van D. Harrison, Jr.

[57] ABSTRACT

Grease compositions, wherein the grease is thickened with a metal hydroxy-containing soap grease thickener are provided. Another essential ingredient of the compositions is a borated alkoxylated alcohol. The compositions may also contain phosphorus and sulfur moieties.

28 Claims, No Drawings

GREASE COMPOSITION CONTAINING BORATED ALKOXYLATED ALCOHOLS

This is a continuation of copending application Ser. No. 831,073, filed on Feb. 18, 1986, now abandoned, which is a continuation of application Ser. No. 643,344, filed Aug. 22, 1984, abandoned.

BACKGROUND OF THE INVENTION

1. Field of the Invention

The invention is concerned with a novel group of compositions. It more particularly relates to a synergistic grease composition comprising oil, hydroxy-containing soap thickener and borated alkoxylated alcohols, and optionally, phosphorus and sulfur moities.

2. Discussion of the Prior Art

Borated alkoxylated alcohols have been used in commercial lubricant formulations to provide improvement in lubricity properties. This is known from U.S. Pat. No. 3,711,411, which discloses hydraulic fluids containing such products.

It is known further that borated esters and related borates can be used in other areas. For example, U.S. Pat. No. 3,740,358 teaches a phenol-aldehyde foamable composition containing a boron compound, e.g. a material formed by reacting boric acid or boric acid with an aliphatic hydroxyl-containing compound. However, so far as is known, no effort has been made to employ borated alkoxylated alcohols in combination with a metal hydroxy-containing soap thickener.

SUMMARY OF THE INVENTION

In accordance with the invention, there is provided an improved grease composition containing a major proportion of a grease and a minor amount of a compound prepared by reacting an alkoxylated alcohol or mixtures of such alcohols having the formula $$RO(R^{1}O)_{x}H$$

where R is a hydrocarbyl group containing from 7 to 30 carbon atoms, preferably 9 to 18 carbon atoms, $R^{1}$ is a hydrocarbylene group containing from 2 to 4 carbon atoms and x is from 1 to 10, with a boron compound which may be boric acid, boric oxide, metaborate or an alkyl borate of the formula $$(R^{2}O)_{y}B(OH)_{z}$$

wherein y is 1 to 3, z is 0 to 2, their sum being 3, and $R^{2}$ is an alkyl group containing from 1 to 6 carbon atoms, the improvement comprising thickening said grease with a hydroxy-containing soap thickener. The presence of phosphorous and sulfur moieties provides an even higher drop point.

Preferably the alkoxylated alcohol is overborated. By "overborated" is meant the presence in the borated product of more than a stoichiometric amount of boron.

"Hydrocarbyl" can be cyclic or a straight or branched chain hydrocarbon group and can contain one or more unsaturated sites. The group is preferably alkyl and thus includes, octyl, nonyl, decyl, dodecyl, isotridecyl, tetradecyl, pentadecyl, heptadecyl and octadecyl. However, it is contemplated that the term also includes propylcylohexyl, butylcyclohexyl, oleyl, stearyl, isostearyl, coco and mixtures thereof as well as similar groups. It should be noted that it is often preferable to use alkoxylated alcohols that have been prepared using a mixture of alcohols. It can also be aryl, in which the aryl nucleus has 6 to 14 carbon atoms. "Hydrocarbylene" is preferably alkylene, including ethylene, propylene and butylene.

DESCRIPTION OF SPECIFIC EMBODIMENTS

While their preparation is not a part of this invention, it should nonetheless be noted that the alkoxylated alcohols are well known, as are methods for preparing them. In general, they can be made by reacting, in the presence of a catalyst, an alcohol with an epoxide such as ethylene oxide or propylene oxide.

Boration of the above-described alkoxylated alcohols is accomplished with the boron compound described above. The reaction can be performed in the presence of a solvent, and in general, any relatively non-polar, unreactive solvent can be used, including benzene, toluene, xylene and 1,4-dioxane. Mixtures of such solvents can also be used. Reaction temperatures of from about 90° C. to about 280° C. can be used. Reaction times can be 1 to 24 hours and more. Up to a stoichiometric amount of boric acid or alkyl borate is preferably used to produce a derivative containing from about 0.1% to about 10% of boron. At least 5 to 10% of the available hydroxyl groups on the alcohol can be borated to derive substantial beneficial effect. Conversely, a stoichiometric excess of boric acid (more than an equivalent amount of borating agent compared to alcohol hydroxyl groups) can also be charged to the reaction medium, resulting in a product containing an even greater amount of boron.

The alcohol ethoxylates can also be borated with an alkyl borate such as mono-, di- or trimethyl borate, mono-, di- or triethyl borate, mono-, di- or tripropyl borate, mono-, di- or tributyl borate, mono-, di- or triaryl borate or mono-, di- or trihexyl borate, often in the presence of boric acid.

Preferred reaction temperatures for boration with the acid is from about 110° C. to about 200° C. and with the borate is from about 160° C. to about 240° C. The temperature chosen will depend for the most part on the particular reactants and on whether or not a solvent is used. In carrying out this reaction, it is preferably that quantities of reactants be chosen such that molar ratio of alkoxylated alcohol to boron compound be from about 6:1 to about 1:6, preferably from about 3:1 to about 2:1. The alcohol as has been noted, can be reacted with an excess of the borating species to form a borate ester containing from about 0.1% by weight of boron to as much as 10% or more of boron.

While atmospheric pressure is generally preferred, the reaction can be advantageously run at from about 1 to about 5 atmospheres.

The times for the reactions are not critical. Thus, any phase of the process can be carried out in from about 1 to about 20 hours.

A narrow class of thickening agents is used to make the grease of this invention. The useful thickening agents are those containing at least a portion of alkali metal or alkaline earth metal or amine soaps of hydroxyl-containing fatty acids, fatty glycerides and fatty esters having from 12 to about 30 carbon atoms per molecule. The metals are typified by sodium, lithium, calcium and barium with lithium being the preferred metal. Preferred members among the acids and fatty materials are 12-hydroxystearic acid and glycerides and esters containing 12-hydroxystearates, 14-hydroxystearic acid, 16-hydroxystearic acid and 6-hydroxystearic acid.

As is evident, the entire amount of thickener need not be derived from the aforementioned members. Significant benefit can be attained using as little as about 15% by weight thereof, based on the total amount of thickener. A complementary amount, i.e., up to about 85% by weight, of a wide variety of thickening agents can be used in the grease of this invention. Included among the other useful thickening agents are alkali metal and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids. The aforementioned thickening agents can be produced in open kettles, pressurized vessels or continuous manufacturing units. All of these production methods are commonly used for greases and have the necessary supporting equipment to process the grease during and after manufacture of the thickener.

Another group of thickener agents comprises substituted ureas, phthalocyamines, indanthrene, pigments such as perylimides, pyromellitdiimides, and ammeline, as well as cerain hydrophobic clays. These thickening agents can be prepared from clays which are initially hydrophilic in character, but which have been converted into a hydrophobic condition by the introduction of long-chain hydrocarbon radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The third member(s) that may be present in the grease composition are the phosphorus and sulfur moieties. Both of these can be present in the same molecule, such as in a metal or non-metal phosphorodithioate of the formula $$\left[(R^3O)_2\overset{\overset{Z}{\|}}{P}Z\right]_n M$$

wherein $R^3$ is a hydrocarbyl group containing 3 to 18 carbon atoms, M is a metal or non-metal, n is the valence of M and Z is oxygen or sulfur, at least one being sulfur.

In this compound, $R^3$ is preferably an alkyl group and may be a propyl, butyl, pentyl, hexyl, octyl, decyl, dodecyl, tetradecyl or octadecyl group, but also includes those deriveds from isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by M include those in Groups IA, IB, IIA, IB, IIB, VIB, and VIII of the Periodic Table. Some that may be mentioned are lithium, sodium calcium, barium, zinc, cadmium, silver, molybdenum and gold. Non-metallic ions include organic groups derived from vinyl esters such as vinyl acetate, vinyl ethers such as butyl vinyl ether and epoxides such as propylene oxide and 1,2-epoxydodecane. Non-metallic ions also include compounds derived from hydrocarbylamines such as alkylamines, tertiaryalkylamines, alkyldiamines or arylamines, as well as those derived from oleylamine, N-oleyl-1,3-propylenediamine, imidazolines and oxazolines.

The phosphorus and sulfur moieties can also be supplied from the combination of two or more separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes and sulfurized jojoba oil. The phosphites embrace the dibutyl, dihexyl, dioctyl, didecyl and similar or phosphites. Hydrocarbyl phosphate esters containing 4 to 20 carbon atoms in each hydrocarbyl group, can also be used. These include esters such as tributyl phosphate, tridecyl phosphate, tricresyl phosphate and mixtures thereof. Mono- and dihydrocarbyl esters are also useful.

In summary, it is essential to the practice of this invention, in which greases having vastly improved dropping points are obtained, that at least the first two of the above-mentioned ingredients be formulated into the composition. Thus:

first, with respect to the preparation of the grease, the total thickener used will have at least about 15% by weight of a metal or non-metal hydroxy-containing soap therein, and there will be present from about 3% to about 20% by weight of total thickener based on the grease composition; and second, there will be added to the composition from about 0.01% to about 10% by weight thereof, preferably about 0.1% to about 2%, of a borated alkoxylated alcohol which has been made by reacting the appropriate alcohol with preferably at least an equimolar amount of boron compound; and as a third component, the composition may have therein from 0.01% to about 10% by weight, preferably from 0.2% to 2% by weight of phosphorus- and sulfur containing compounds or a mixture of two or more compounds which together supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated alkoxylated alcohol, the dropping point of the grease was consistently unexpectedly higher than with a grease from the same grease vehicle and the same borated alkoxylated alcohol, but with a different thickener, e.g., non-hydroxy-containing thickener. Thus, the broad invention is a grease composition comprising the two components mentioned.

In general, the reaction products of the present invention may be employed in any amount which is effective for imparting the desired degree of friction reduction, antiwear activity, antioxidant activity, high temperature stability or antirust activity. In many applications, however, the borated alkoxylated alcohol and the phosphorus- and/or sulfur-containing compound(s) are effectively employed in combined amounts of from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various materials may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, luquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers. Other additives providing antirust, antioxidant antiwear/EP, anticorrosion, and other desired properties can be used with the greases of this invention.

The metallic soap grease compositions containing one or more of the borated alkoxylated alcohols, and optionally, one or more of the sulfur and phosphorus combinations described herein provide advantages in increased dropping point, improved grease consistency properties, antirust characteristics and pontential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention.

EXAMPLE 1

BORATED ALCOHOL ETHOXYLATE $C_{12}$ to $C_{15}$ alkanol triethoxylate was commercially obtained. It had an average molecular weight of 338 and contained approximately 3.0 ethylene oxide groups. The hydroxyl number was 166.

Approximately 175 g of the $C_{12}$ to $C_{15}$ alcohol triethoxylate described above was charged to a 500 ml glass reactor equipped with agitator, Dean-Stark tube and slow nitrogen purge of vapor space. Approximately 13 g of boric acid and about 500 g of toluene were added and the reaction mixture was heated to 160° C. over a period of 6 hours until azeotropic distillation of water ceased. Approximately 120 g of water was collected. Solvent was removed by vacuum distillation and the product was filtered through diatomaceous earth to yield a clear, light-colored oil soluble fluid.

EXAMPLE 2

BORATED ALCOHOL ETHOXYLATE

Approximately 274 g of alcohol ethoxylate commercially obtained was charged to a 1000 ml reactor equipped as in Example 2. The alcohol ethoxylate contained approximately 2.6 moles of ethylene oxide per mole of mixed $C_9$ to $C_{11}$ alcohol. The molecular weight was approximately 274 and had a hydroxyl number of 205. Approximately 22 g of boric acid and about 50 g of toluene solvent were charged. The reactor mixture was heated to 195° C. over a period of 4 hours unitl azeoptric distillation of water ceased. The toluene was removed by azeotropic distillation and the product was filtered over diatomaceous earth to yield a clear, light-colored oil soluble liquid.

EXAMPLE 3

A lithium hydroxystearate grease thickener was prepared by saponification of mixture containing 12-hydroxystearic acid (8%) and the glyceride thereof (9%) with lithium hydroxide in a mineral oil vehicle at about 177° C. in a closed contactor. After depressing and dehydrating the thickener in an open kettle, sufficient mineral oil was added to reduce the thickener content to about 9.0%. After cooling to about 99° C., a typical additive package, consisting of an amine antioxidant, phenolic antioxidant, metallic dithiophosphate, sulfur-containing metal deactivator and nitrogen containing antirust additives, was added.

EXAMPLE 4

Two percent by weight of the boration product of Example 1 was added at 110° C. to 115° C., with vigorous stirring, to the base grease of Example 3.

EXAMPLE 5

Same as Example 4, except that the boration product of Example 2 was used.

The grease compositions of this invention were tested for dropping point characteristics in accordance with ASTM D2265. The results are summarized in Table 1.

EXAMPLE 6

Base grease thickened with the lithium soap of a 50/50 (wt) mixture of stearic and palmitic acids.

EXAMPLE 7

50 wt. % of the base grease of Example 3 and 50 wt. % of the base grease of Example 6.

EXAMPLE 8

Base grease of Example 6 plus 2% of the borated ethoxylate of Example 1.

TABLE 1

| Sample | 02245 Dropping Point, °C. |
|---|---|
| Base grease of Example 3 (containing amine antioxidant, | 202 |

TABLE 1-continued

| Sample | 02245 Dropping Point, °C. |
|---|---|
| phenolic antioxidant, 1.5% zinc dithiophosphate*, and sulfur-containing metal deactivator and nitrogen containing antirust additives) | |
| Example 4 | |
| 2% of Example 1 Product Plus Base Grease of Example 3 | 237 |
| Example 5 | |
| 2% of Example 2 Product Plus Base Grease of Example 3 | 305 |
| Example 6 Grease | 209 |
| Example 7 Grease | 190 |
| Example 8 Grease | 207 |

*Derived from mixed $C_3$ secondary (isopropyl) and $C_6$ primary alcohols.

We claim:

1. A grease composition comprising a major amount of an oleaginous lubricant, from about 0.01% to about 10% by weight of the composition of an additive for elevating the dropping point of a grease comprising a reaction product made by reacting an alkoxylated alcohol of the formula $$(RO)(R^1O)_xH$$

wherein R is a hydrocarbyl group or a mixture of hydrocarbyl groups, containing from 8 to 30 carbon atoms, $R^1$ is a $C_2$ to $C_4$ hydrocarbylene group and x is from 1 to 7, with a boron compound selected from the group consisting of boric acid, boric oxide, metaborate and an alkyl borate of the formula $$(R^2O)_yB(OH)_z$$

wherein y is 1 to 3, z is 0 to 2, their sum being 3, and $R^2$ is an alkyl group having 1 to 6 carbon atoms, and a thickener containing at least about 15% by weight of a hydroxy-containing soap.

2. The composition of claim 1 additionally containing from about 0.01% to about 10% by weight of the composition of a phosphorus and sulfur compound or a mixture of phosphorus-containing and sulfur-containing compounds to supply an equivalent amount of phosphorus and sulfur.

3. The composition of claim 1 wherein the soap is an alkali metal, alkaline earth metal or amine soap of a hydroxy-containing fatty acid, fatty glyceride or fatty ester containing 12 to 30 carbon atoms.

4. The composition of claim 3 wherein the metal is sodium, lithium, calcium or barium.

5. The composition of claim 1 wherein R is octyl, nonyl, decyl, dodecyl, tetradecyl, pentadecyl, heptadecyl, octadecyl or mixtures thereof and $R^1$ is ethylene, propylene or butylene.

6. The composition of claim 2 wherein the thickener is derived from 12-hydroxystearic acid, 14-hydroxystearic acid, 16-hydroxystearic acid, 6-hydroxystearic acid or the ester or glyceride thereof.

7. The composition of claim 1 wherein R is mixed $C_{12}$ to $C_{15}$ alkanol, $R^1$ is ethylene and x is 3.

8. The composition of claim 1 wherein R is nonyl, $R^1$ is ethylene and x is 2.6.

9. The composition of claim 1 wherein the boron compound is boric acid.

10. The composition of claim 2 wherein the phosphorus and sulfur moieties are supplied by a phosphorothioate of the formula

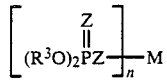

wherein $R^3$ is a hydrocarbyl group containing 3 to 18 carbon atoms, M is a metal or non-metal, n is the valence of M and Z is oxygen or sulfur, at least one of which is sulfur.

11. The composition of claim 10 wherein $R^3$ is an alkyl group or alkaryl group.

12. The composition of claim 11 wherein $R^3$ is a propyl, butyl, pentyl, hexyl, oxtyl, dodecyl, tetradecyl, octadecyl, butylphenyl, octylphenyl, nonylphenyl, dodecylphenyl or oleyl group or mixtures thereof.

13. The composition of claim 12 wherein $R^3$ is derived from isopropanol, butanol, isobutanol, sec-butanol, 4-methyl-2-pentanol, 2-ethylhexanol or mixtures thereof.

14. The composition of claim 10 wherein M is a metal from Group IA, IB, IIA, IIB, VIB or VIII of the Periodic Table.

15. The composition of claim 14 wherein the metal is lithium, sodium, calcium, barium, zinc, cadmium, molybdenum or gold.

16. The composition of claim 15 wherein the metal is zinc.

17. The composition of claim 15 wherein the metal is molybdenum.

18. The composition of claim 10 wherein M is derived from vinyl acetate, butyl vinyl ether, propylene oxide, 1,2-epoxydodecane, alkylamines, alkyldiamines or arylamines.

19. The composition of claim 2 wherein the phosphorus and sulfur moieties are supplied by a combination of (1) a dihydrocarbyl phosphite having 2 to 10 carbon atoms in each hydrocarbyl group, mixtures of such phosphites, a dihydrocarbyl phosphate ester having 4 to 20 carbon atoms in each hydrocarbyl group, mixtures of such phosphates or of such phosphites and phosphates and (2) a sulfide selected from a sulfurized isobutylene, a dibenzyl disulfide, a sulfurized terpene and a sulfurized jojoba oil.

20. The composition of claim 19 wherein the phophite is a dibutyl, dihexyl, dioctyl or didecyl phosphite or mixtures thereof.

21. The composition of claim 19 wherein the phosphate ester is a tributyl, tridecyl or tricresyl phosphate or mixtures thereof.

22. The composition of claim 19 wherein the alkoxylated alcohol is a mixed $C_{12}$ to $C_{15}$ alkanol triethoxylate, the boron compound is boric acid and the phosphorus- and sulfur-containing compound is zinc dialkyl phosphorodithioate wherein the alkyl group is derived from mixed $C_3$ secondary and $C_6$ primary alcohols.

23. The composition of claim 19 wherein the alkoxylated alcohol is a mixed $C_9$ to $C_{11}$ alkanol ethoxylate containing 2.6 moles of ethoxide, the boron compound is boric acid and the phosphorus- and sulfur-containing compound is zinc dialkyl phosphorodithioate wherein the alkyl group is derived from mixed $C_3$ secondary and $C_6$ primary alcohols.

24. The composition of claim 1 wherein the oleaginous lubricant is a mineral oil.

25. The composition of claim 1 wherein the oleaginous lubricant is a synthetic oil.

26. The composition of claim 1 wherein the oleaginous liquid is a mixture of mineral and synthetic oils.

27. A method of preparing a grease composition comprising adding to an oleaginous lubricant from about 0.01% to about 10% by weight of the total composition an additive for elevating the dropping point comprising the reaction product made by reacting an alkoxylated alcohol of the formula $$(RO)(R^1O)_xH$$

wherein R is a hydrocarbyl group or a mixture of hydrocarbyl groups, containing from 8 to 30 carbon atoms, $R^1$ is a $C_2$ to $C_4$ hydrocarbylene group and x is from 1 to 7, with a boron compound selected from the group consisting of boric acid, boric oxide, metaborate and an alkyl borate of the formula $$(R^2O)_yB(OH)_z$$

wherein y is 1 to 3, z is 0 to 2, their sum being 3, and $R^2$ is an alkyl group having 1 to 6 carbon atoms, and a thickener containing at least about 15% by weight of a hydroxy-containing soap thickener.

28. The method of claim 27 and adding from about 0.01% to about 10% by weight of the composition of a phosphorus and sulfur compound or a mixture of phosphorus-containing compounds and sulfur-containing compounds to supply an equivalent amount of phosphorus and sulfur.

* * * * *